US007513203B2

(12) United States Patent
Eklund

(10) Patent No.: US 7,513,203 B2
(45) Date of Patent: Apr. 7, 2009

(54) METHOD AND ARRANGEMENT FOR A SEWING MACHINE

(75) Inventor: Henrik Eklund, Huskvarna (SE)

(73) Assignee: VSM Group AB, Huskvarna (SE)

( * ) Notice: Subject to any disclaimer, the term of this patent is extended or adjusted under 35 U.S.C. 154(b) by 0 days.

(21) Appl. No.: 11/443,294

(22) Filed: May 31, 2006

(65) Prior Publication Data

US 2006/0278149 A1 Dec. 14, 2006

(30) Foreign Application Priority Data

Jun. 1, 2005 (SE) ..... 0501248

(51) Int. Cl.
*D05B 45/00* (2006.01)
*D05B 47/00* (2006.01)

(52) U.S. Cl. ..... 112/302; 112/475.17

(58) Field of Classification Search ..... 112/302, 112/254, 255, 241, 246, 270, 475.01, 475.17
See application file for complete search history.

(56) References Cited

U.S. PATENT DOCUMENTS 4,215,641 A * 8/1980 Dobrjanskyj et al. ..... 112/278
4,408,554 A * 10/1983 Takiguchi et al. ..... 112/302
4,590,879 A * 5/1986 Matsubara et al. ..... 112/278
4,766,827 A * 8/1988 Matsubara ..... 112/278
5,345,887 A * 9/1994 Droste ..... 112/255
5,404,824 A * 4/1995 Hiraoka et al. ..... 112/254
5,983,818 A 11/1999 Tramutolo et al.
6,092,478 A * 7/2000 Simakrai et al. ..... 112/278
6,422,164 B1 * 7/2002 Gries et al. ..... 112/286
7,225,747 B2 * 6/2007 Friman et al. ..... 112/475.01

* cited by examiner

*Primary Examiner*—Ismael Izaguirre
(74) *Attorney, Agent, or Firm*—Venable LLP; Eric J. Franklin

(57) ABSTRACT

A sewing machine including a needle that is supplied with an upper thread. A a reciprocating movement carries the upper thread through a sewing material and forms a loop beneath the sewing material. A shuttle houses a bobbin for lower thread and a shuttle arm catches the loop of the upper thread and carries the upper thread around the lower bobbin, so that a stitch is executed on the sewing material. A thread feeder feeds the upper thread to the needle and a control element on each stitch causes the thread feeder at the beginning of a stitch to advance a predetermined length of upper thread, including an excess thread, and at the end of the stitch to correct the length of the upper thread by recovering the excess upper thread, or advancing the further upper thread required.

17 Claims, 2 Drawing Sheets

METHOD AND ARRANGEMENT FOR A SEWING MACHINE

CROSS-REFERENCE TO RELATED APPLICATIONS

This application claims priority to Swedish patent application 0501248-9 filed Jun. 1, 2005.

TECHNICAL FIELD

The present invention relates to an arrangement and a method for a sewing machine. In particular the invention demonstrates a method and an arrangement for improving access to the upper thread in the formation of a stitch, which in turn permits an increase in the volume of a bobbin which stores the lower thread, so that this bobbin does not need to be changed as frequently as in hitherto known sewing machines of corresponding type.

PRIOR ART

Sewing machines of the lockstitch type have long been known in the art and their operating principle is well-known. If, for the sake of simplicity, a sewing machine with a single needle is taken as an example, the stitches in this machine are formed in that an upper thread and a lower thread are knotted together be means of a needle, which moves with a reciprocating motion through a sewing material that is advanced over a work plate which usually lies in a plane basically at right angles to the extent of the needle. The upper thread is drawn out from a bobbin, which stores the upper thread, by means of a thread tensioning and take-up lever, which through an oscillating movement towards and away from the sewing material supplies the needle with upper thread. The term "upper" hereinafter relates to the side of the sewing material where the needle is housed. "Lower" relates to the side of the sewing material where a knot is tied.

When the thread tensioning and take-up lever is in its bottom position the maximum quantity of thread has been drawn out for the stitch, following which the thread tensioning and take-up lever in its movement turns upwards again. After reversing of the thread tensioning and take-up lever, the thread will form a loop under the sewing material, since the drawn-out thread is not immediately all drawn back by the thread tensioning and take-up lever.

The lower thread is reeled off from a lower bobbin, which is accommodated in a shuttle under the sewing material. The shuttle may be of rotating type and is equipped with a shuttle arm (sometimes called a shuttle beak), which through the rotational movement of the shuttle catches in the loop that has been formed by the upper thread and in its continued movement leads the upper thread around the lower bobbin.

When the thread tensioning and take-up lever in its oscillating movement is returned upwards away from the sewing material, the thread tensioning and take-up lever draws back the excess quantity of upper thread, that is to say the quantity of thread that is not used in the actual stitch. The thread pulled out which formed said loop will be drawn tight, forming a lock stitch through interaction of the upper thread and the lower thread, since the shuttle has taken the upper thread around the lower thread. Another device on the sewing machine now advances the fabric for a following stitch.

The said oscillating movements performed by the needle, the thread tensioning and take-up lever and the shuttle are synchronized with one another and are repeated cyclically for each stitch executed by the sewing machine.

One of the limitations inherent in the prior art is that the bobbin for the lower thread has a limited storage capacity for the lower thread, so that this lower bobbin has to be changed fairly frequently for a lower bobbin filled with lower thread, This is time-consuming and awkward.

The thread tensioning and take-up lever has a certain stroke length in order to form said upper thread loop. The stroke length of the thread tensioning and take-up lever is adjusted so that the thread drawn out gives said loop a circumference such that the upper thread loop is sufficient to allow it to be carried around the lower bobbin by the shuttle.

Within the art efforts have been made to increase the volume of the lower bobbin, so that this will accommodate more lower thread. A restricting factor in these attempts has been precisely this stroke length of the thread tensioning and take-up lever. There is naturally scope to increase the stroke length of the thread tensioning and take-up lever, in order that the thread tensioning and take-up lever will produce a thread loop having a larger circumference. For reasons of space, however, an increased stroke length of the thread tensioning and take-up lever is not desirable. It is furthermore desirable to avoid larger mechanical movements which, among other things, result in an increase in the maximum speed and acceleration of the thread tensioning and take-up lever, which places greater stresses on the mechanical drive parts and increases the risk of vibrations in the sewing machine. A larger stroke length also means that a large part of the basic mechanical structure of the machine has to be modified. The external dimensions of the sewing machine may also have to be increased in order that the sewing machine will accommodate a thread tensioning and take-up lever with a larger stroke length than in corresponding unmodified sewing machines.

One approach to a solution to the problem outlined above is described in U.S. Pat. No. 5,983,818. This specification describes an arrangement having two thread tensioning and take-up levers, which interact to permit the formation of a larger upper thread loop, so that a considerably larger lower thread bobbin can be provided. One disadvantage with the solution demonstrated is a considerably more complicated mechanism than hitherto used in sewing machines. The said specification also refers to another known system, which demonstrates alternative solutions to the problem described.

An object of the present invention is to demonstrate an entirely novel solution to the problem described.

DESCRIPTION OF THE INVENTION

In the prior art the entire stroke length of the thread tensioning and take-up lever is utilised in order to produce a loop in the upper thread which has a circumference large enough to allow the upper thread to be carried around lower bobbin by the shuttle. The length of the thread loop is then basically twice the stroke length of the thread tensioning and take-up lever. According to the invention both a thread tensioning and take-up lever and a thread feeder are used in order to feed the upper thread to the needle. Such an arrangement means that one is not dependent on the stroke length of the thread tensioning and take-up lever to produce the required size of the upper thread loop, which is needed in order to allow the upper thread to be carried around the lower bobbin. By means of a control element in the sewing machine, which controls the thread feeder, the required length of thread can be fed during a stitch, following which the thread length at the end of the stitch can be corrected in order that the correct thread length will be available when the thread tensioning and take-up lever draws tight the knot in the stitch. Said correction is performed by the thread feeder, which usually retracts the upper thread, but in certain cases with very long stitches a further feed advance becomes necessary for the correction at the end of the stitch.

The advantage of the measures and the arrangements according to the invention described above is that a significantly longer thread loop can be made available for the shuttle. This longer thread loop means that the diameter of the lower bobbin can be increased, so that the quantity of lower thread which can be stored in the lower bobbin can be substantially increased. An increased thread quantity with up to 50% more thread stored in the lower bobbin than in the prior art is perfectly feasible according to the invention. The limit on how much extra upper thread, that is to say the excess thread, which can be fed out by the thread feeder over and above the calculated thread consumption for the stitch is set by the time that is available before the stitch is completed by drawing tight the knot in the stitch. The mechanical units of the thread feeder, for example, must manage to retract all the excess upper thread in the stitch before this is completed. The invention furthermore allows the upper thread loop that is carried around the lower bobbin to be increased relatively easily, without the need to modify too much of the basic mechanical construction of the sewing machine compared, for example, to what would be required in the case of modifications to the stroke length of the thread tensioning and take-up lever as described above.

In order to further elucidate the relationships between said length elements of the upper thread during a stitch, this may be described in the following terms:

s is the stroke length of the thread tensioning and take-up lever, d is the excess thread according to the invention, x is the length of the thread needed for the actual stitch.

According to the prior art the greatest thread loop length will be in the order of 2s. When the thread tensioning and take-up lever, according to the prior, has drawn tight the knot in the stitch the thread tensioning and take-up lever will have recovered 2s−x of the upper thread from the loop, since the length x is needed for the stitch.

According to the invention the thread feeder, for a new stitch, advances the length, that is to say x, of the upper thread that is needed for the next stitch, and an excess thread d. The loop in the upper thread for the now current stitch can have the length 2s+d (the fact that the stitch length in two successive stitches may vary, so that x may be different for different stitches, is here disregarded). Access to the length 2s of the upper thread that is needed for the stroke of the thread tensioning and take-up lever it obtained through the movement of the thread tensioning and take-up lever from its upper to its lower reversing point and back again for each completed period for one stitch.

When the shuttle has caught in the loop and carried the upper thread around the lower thread bobbin, the thread tensioning and take-up lever move upwards and begins to gather the loop together. In this phase the thread feeder is made to retract thread if the excess thread d is greater than the thread consumption x in the stitch. All the thread d−x must thereby be retracted. If, on the other hand, the stitches are long, so that the thread consumption x may be greater than the excess thread d, the thread feeder feeds out further thread (x−d) in the stitch before the thread tensioning and take-up lever reaches its upper reversing point, that is to say when the knot is drawn tight and the stitch is completed. According to the invention, therefore, it may also be advantageous to keep the excess thread d somewhat less then the maximum possible quantity, since the thread feeder thereby seldom has to retract the entire excess thread on every stitch, but rather meanwhile feeds out further thread when the stitches are long, as has been demonstrated.

A significant advantage of the invention is that the size of the lower bobbin can be increased. This can thereby store a greater quantity of lower thread, so that the lower thread needs to be replenished less often, an operation which is very disruptive in sewing work.

The thread feeder may comprise a thread apportioning mechanism of the type described below. However, any arrangement which apportions the upper thread may be used in the invention. This is therefore feasible with a motor, such as a stepping motor, which drives rollers, between which the thread is clamped and advanced. Another variant may consist of magnets, which cyclically clamp the upper thread between two plates, which are driven by the magnets to repeatedly move the plates in the longitudinal direction of the thread whilst they are clamped together.

The sewing machine control element comprises a processor, which gathers information on parameters set by the sewing machine operator and by data on the current positions of mechanical elements relevant for correct execution of a selected seam, and which controls the sewing of the sewing machine using these parameters and current positions as a basis. Such control is known and does not form part of the invention, so that it will not be described here.

The control element controls the drive element for the thread feeder, for example said motor, where the drive element is used for undertaking an adjustment of the upper thread consumption per stitch, calculated in the processor, and the excess thread described.

Further characteristics of the present invention are demonstrated in the following detailed description, which is to be interpreted in association with the drawings attached. It must be emphasized that the drawings are given solely for the purpose of illustration and do not limit the invention. The drawings are not drawn to scale and only show the underlying concept of structures and procedures described herein.

DETAILED DESCRIPTION OF EMBODIMENTS

A number of embodiments for implementing the invention will be described below with reference to the drawings attached.

Figure 1:
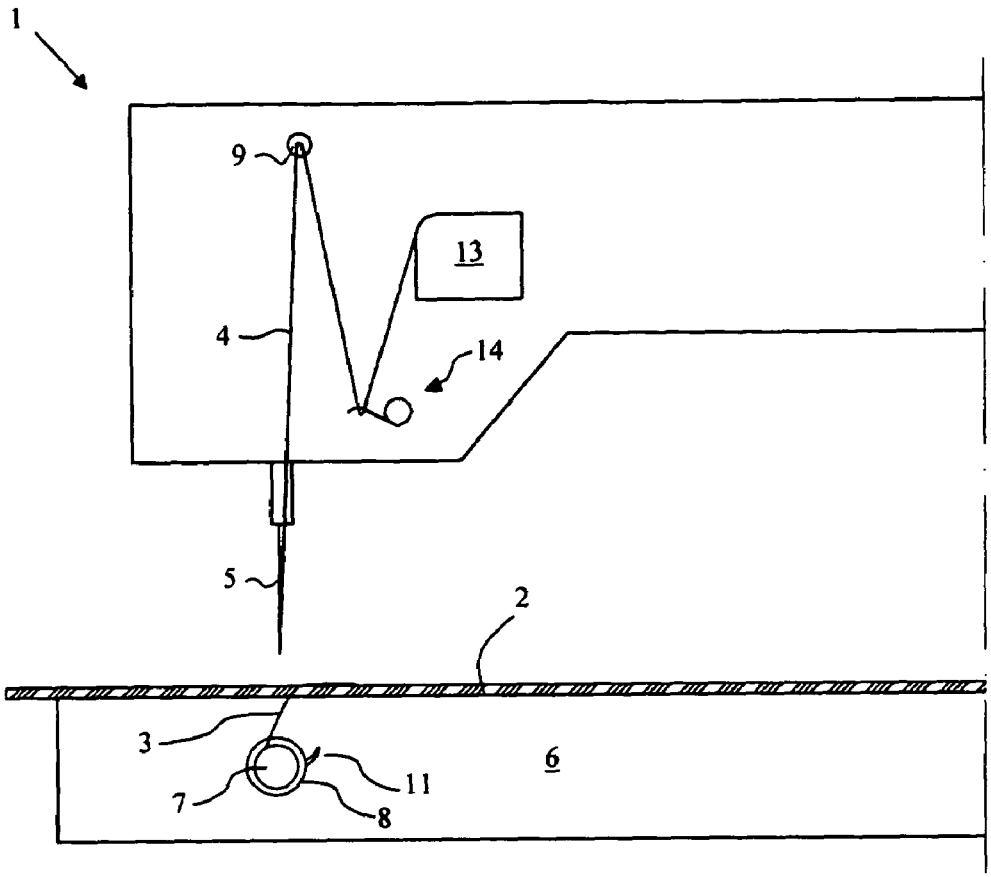
FIG. 1 in a schematic outline sketch shows a front view of a sewing machine with a thread feeder.
Figure 2:
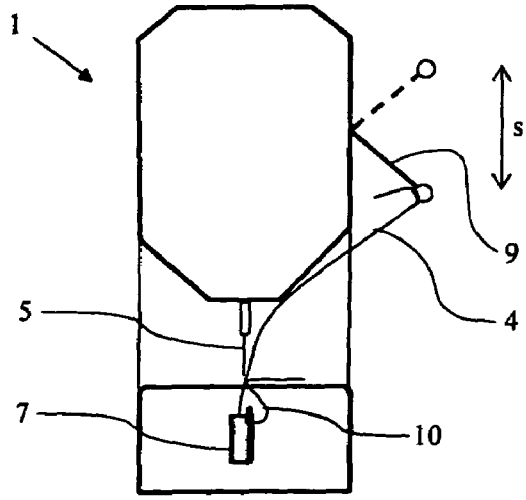
FIG. 2 in a schematic outline sketch shows a side view of the sewing machine according to FIG. 1, showing the top and bottom positions of the thread tensioning and take-up lever to illustrate the stroke length, the shuttle with shuttle arm and thread loop being illustrated inside the work plate.
Figure 3:
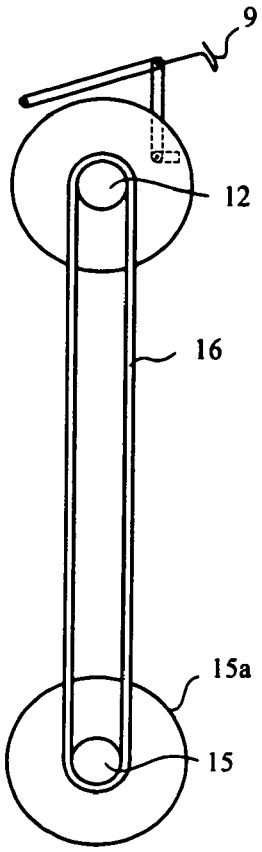
FIG. 3 shows a schematic representation of the drive in a sewing machine, with two main shafts connected by a belt, which perform one revolution for each stitch made by the sewing machine.

FIGS. 1 and 2 symbolically represent a sewing machine 1, in which a sewing material, in the form of a fabric 2, is advanced in a known manner between a lower thread 3 and an upper thread 4 for executing a seam, which is built up from the required stitches produced by means of a needle 5, which is periodically carried through the fabric 2. In the example the fabric 2 is carried over a work plate 6, which also houses a bobbin 7 intended for the lower thread 3 and encapsulated in a shuttle 8. The upper thread 4 is led via a thread tensioning and take-up lever 9, which through a cyclically upward and downward movement produces a loop 10 in the upper thread 4, when the needle 5, through the eye of which the upper thread runs, has brought the upper thread through the fabric 2 and the thread tensioning and take-up lever 9 returns upward from its bottom position. A shuttle arm 11 catches in the loop 10 when the shuttle 8 rotates. For executing a stitch, in this case a lock stitch, the needle 5 is set into a reciprocating movement controlled by a first main shaft 12 (see FIG. 3), so that the needle 5 leads the upper thread 4 down through the fabric 2, following which the shuttle 8 carries the upper thread 4 around the bobbin 7, which houses the lower thread 3, a knot being produced in the fabric 2 when the needle 5 has been brought up through the fabric 2 and the thread tensioning and take-up lever 9 draws tight the knot in the stitch.

The upper thread 4 is fed out by way of a thread feeder 13, which distributes thread to the thread tensioning and take-up lever 9 via a thread sensor spring 14.

Figure 4:
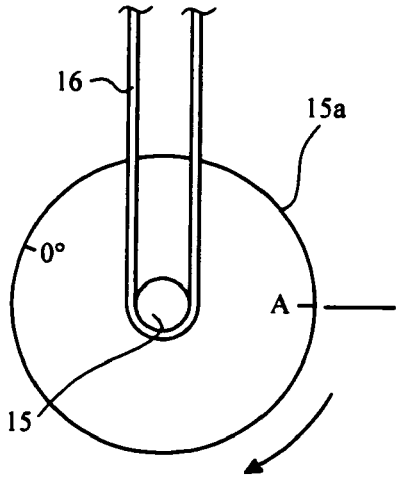
FIG. 4 represents the position of an angle sensor on one of the main shafts at the point when a knot in the stitch is drawn tight.
Figure 6:
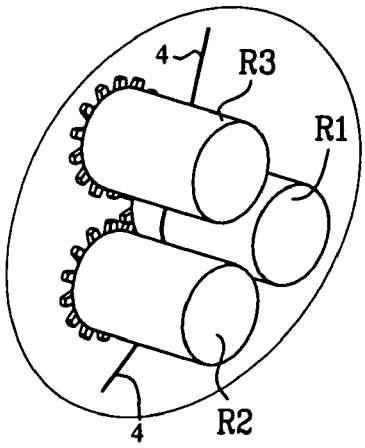
FIG. 6 shows a perspective view of an example of an upper thread driven by means of said rollers.

Belonging to the machine is a control program, which is stored in a processor C. The control program receives information on the rotational position of a second main shaft 15, for example by reading off a certain rotational position A in relation to a reference position 0° for the second main shaft 15 (see FIG. 4) by means of an angle sensor 15*a*. Since the first main shaft 12 and the second main shaft 15 are coupled to one another, for example by means of a belt 16, and the thread tensioning and take-up lever 9 and the needle 5 are moreover controlled by the movement of these shafts, the movements of the main shafts 12, 15, the thread tensioning and take-up lever 9 and the needle 5 are synchronised with one another in a cyclical pattern of movements, the control program also being capable of receiving information on the position of the thread tensioning and take-up lever 9 and the needle 5 in the cyclical sequence. Predetermining the thread consumption per stitch through a calculation of the stitch parameters for the current stitch in a chosen seam is already known in the art. A calculation to predetermine the thread consumption per stitch in this way is performed in the processor of the sewing machine according to the invention and constitutes the basis for the feeding by a motor M, which produces the thread feed.

Figure 5:
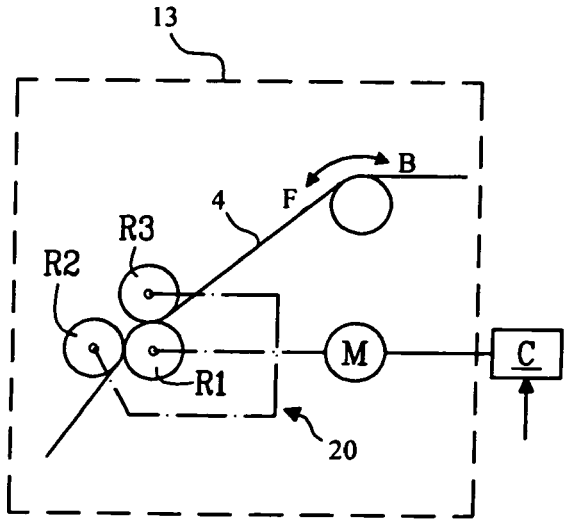
FIG. 5 shows a schematic representation of a thread feeder which feeds the upper thread by means of rollers, which are driven by a motor, which is in turn controlled by a processor.

FIG. 5 shows a schematic representation of a thread feeder 13, which is controlled by a processor C. Input data in the form of control parameters to the processor C are illustrated solely in the form an arrow pointing into the processor. The processor stores data relating to the position A, in which a knot in a stitch must be correctly drawn tight, the position A in this example relating to the angle of rotation of the second main shaft 15. The processor C is furthermore designed to control a stepping motor M, which is mechanically coupled to three drive rollers R1, R2 R3, via a transmission mechanism denoted by 20 in the drawing. An embodiment in which the motor M consists of a stepping motor is described here, but other types of drive element controlled in some way other than by stepping can obviously also be used. The upper thread 4 is led between the rollers R1, R2 R3, stepping of the motor M causing the upper thread 4 to be fed forwards toward the needle 5 or fed backwards away from the needle 5. The quantity of thread fed forwards or backwards is determined by the number of steps by which the motor is stepped. The upper thread 4 is fed forwards when the motor is stepped in the forwards direction, indicated by F, and is fed backwards when the motor is stepped in the reverse direction, indicated by B. The feed is designed to be controlled as a function of the type of stitch, thread thickness, fabric etc. The number of steps by which the motor is driven forwards during a stitch is primarily controlled by the calculated value for the thread feed that is required.

In the present invention a predetermined extra thread feed is performed, which is not associated with the stitch, this extra feed instead being designed to ensure that the loop 10 of the upper thread 4 will be long enough to allow the upper thread to be carried around a lower bobbin 7 of a larger volume than is currently common and possible in the prior art, without the need for modification of the mechanical elements of the sewing machine. The thread tensioning and take-up lever 9, the stroke length s of the thread tensioning and take-up lever, the needle 5, the shuttle 8 and the mechanical feeds can therefore be designed as in a conventional sewing machine. The additional feed that is performed on each stitch by means of the thread feeder 13 is here referred to as the excess thread and is denoted here by d. As previously stated, the excess thread is limited by the time that is available for the extra thread that is fed out to be retracted before completion of the current stitch (in the most extreme case in which the quantity recovered may be equal to d). In a standard sewing machine this extra feed, the excess thread d, is preferably in the order of 8 mm. With such a value of the excess thread d, the lower bobbin 7 can be designed to store approximately 50% more thread than is possible on a corresponding sewing machine of conventional art. The excess thread d may naturally be of some other length, but in the case of advancing by means of a stepping motor according to the present example the excess thread preferably falls within the interval $0.5<d<20$ mm. Even greater excess threads are quite feasible, however, so that the interval quoted must not be regarded as a limitation. Besides the time and mechanical restrictions the upper limit for the excess thread d may depend, for example, on what type of thread feeder is being used.

The quantity of thread that is fed out by the thread feeder in connection with the extra feed in the form of the excess thread d need not be constant but can be varied with the thread consumption x in the stitch. Thus, for example, if the thread consumption x in the stitch is greater than the predetermined excess thread d, the thread feed from the thread feeder during the stitch can instead be set to be identical to the thread consumption x (in principle this means that d is set equal to x for the current stitch). This means that no subsequent return feed of upper thread will be required during the stitch.

When the thread tensioning and take-up lever 9 is on the return stroke (or expressed by another parameter when the upper thread has been laid around the lower bobbin), the thread feeder 13 is made:

- to recover the excess thread that is not consumed in the stitch, that is to say the part of the extra feed that is performed by the thread feeder in order to provide the excess thread d, or
- to feed out further thread, if it proves that the predetermined excess thread d, for an unusually long stitch, is less than the thread quantity that is consumed in the stitch. The excess thread d is preferably set to be constant regardless of the stitch length.

According to a further embodiment a deviation from the calculated thread consumption x is adjusted manually.

As will be seen from FIG. 5, the thread feeder is made during a stitch to feed out the excess thread d in the direction F during the time when the thread tensioning and take-up lever 9 is descending towards the sewing material 2.

Although the present invention has been described in connection with specific embodiments it is not intended to be limited to the specific form(s) in which they have been represented in this description. In reality the scope of the present invention is only limited by the following patent claims. In the claims, such terms as comprising or including do not exclude the presence of other elements or steps. Furthermore, although not individually listed, a plurality of arrangements, elements or steps in the method may be implement in a single unit, for example. In addition, although individual characteristics may be included in different patent claims, these may feasibly be advantageously combined and the inclusion in different patent claims does not means that a combination of characteristics is not suitable and/or advantageous. Singular references moreover do not exclude a plurality. References to "one", "first", "second" etc. therefore do not preclude the existence of a plurality, unless this is explicitly emphasized. Reference numerals in the patent claims are only provided as elucidatory examples and must not be interpreted as limiting the scope of the patent claims in any way.

The invention claimed is:

1. A sewing machine, comprising:

a needle which is supplied with an upper thread;

a drive element which drives the needle to perform a reciprocating movement in order to carry the upper thread through a sewing material which is advanced between the upper thread and the lower thread, so that the upper thread forms a loop beneath the sewing material;

a shuttle which houses a lower bobbin for the lower thread;

a shuttle arm on the shuttle which catches in the loop of the upper thread and carries the upper thread around the lower bobbin, so that a stitch is executed on the sewing material; and a thread tensioning and take-up lever which on each stitch draws tight a knot that is formed in the sewing material by interaction of the upper thread and the lower thread;

a thread feeder for feeding the upper thread to the needle;

a control element which controls the advance of the thread from the thread feeder, so that the thread feeder on each stitch:

advances a predetermined length of upper thread, including an excess thread at the beginning of a stitch and corrects the length of the upper thread on completion of the stitch in order that the thread tensioning and take-up lever will receive the correct length of the upper thread when the knot in the stitch is drawn tight, in that the thread feeder either retracts the excess upper thread, or advances the further upper thread required.

2. The sewing machine according to claim 1, wherein the excess thread lies in the interval 0.5 mm<d<20 mm.

3. The sewing machine according to claim 1, further comprising:

a sewing machine processor operative to calculate a thread consumption for a stitch.

4. The sewing machine according to claim 3, wherein a deviation from the calculated thread consumption for a stitch can be adjusted manually.

5. The sewing machine according to claim 3, wherein the thread feeder during a stitch is made to feed out the excess thread in a direction F during the time when the thread tensioning and take-up lever is descending towards the sewing material.

6. The sewing machine according to claim 3, wherein during a stitch a thread length d−x is retracted, when the thread tensioning and take-up lever is ascending from the sewing material.

7. The sewing machine according to claim 3, wherein during a stitch a thread length x−d is fed out, during the time when the thread tensioning and take-up lever is ascending from the sewing material.

8. The sewing machine according to claim 3, wherein the thread feeder during a stitch is made to feed out the excess thread in the direction F during the time when the shuttle is carrying the upper thread around the lower bobbin.

9. The sewing machine according to claim 3, wherein during a stitch a thread length d−x is retracted, after the point when the loop of the upper thread has been taken around the lower bobbin and begins to be drawn tight.

10. The sewing machine according to claim 3, wherein during a stitch a thread length x−d is fed out, after the point when the loop of the upper thread has been taken around the lower bobbin and begins to be drawn tight.

11. A method in a sewing machine for advancing more thread during a stitch than is consumed in said stitch, the sewing machine comprising:

a needle which is supplied with an upper thread, a drive element which drives the needle to perform a reciprocating movement in order to carry the upper thread through a sewing material which is advanced between the upper thread and the lower thread, so that the upper thread forms a loop beneath the sewing material, a shuttle which houses a lower bobbin for the lower thread, a shuttle arm on the shuttle which catches in the loop of the upper thread and carries the upper thread around the lower bobbin, so that a stitch is executed on the sewing material, and a thread tensioning and take-up lever which on each stitch draws tight a knot that is formed in the sewing material by interaction of the upper thread and the lower thread, the method comprising:

feeding the upper thread to the needle with a thread feeder, advancing the thread with a control element which controls the thread feeder, advancing a predetermined length of upper thread including an excess thread with the thread feeder on each stitch; and correcting the length of the upper thread during the stitch in order that the thread tensioning and take-up lever will receive the correct length of the upper thread when the knot in the stitch is drawn tight, either by retracting an excess upper thread, or advancing the further upper thread required.

12. The method according to claim 11, further comprising:

feeding out the predetermined thread length, which is advanced by the thread feeder during a stitch, during a time interval during which the thread tensioning and take-up lever is descending toward the sewing material.

13. The method according to claim 11, further comprising:

retracting in a direction B thread that is not consumed during a stitch, during a time interval during which the thread tensioning and take-up lever is ascending from the sewing material.

14. The method according to claim 11, further comprising:

feeding out an extra thread length, which is the difference between a thread consumption for a stitch and the excess thread, in a direction F during a time interval during which the thread tensioning and take-up lever is ascending from the sewing material.

15. The method according to claim 11, further comprising:

during a stitch making the thread feeder feed out the excess thread in a direction F during the time when the shuttle carries the upper thread around the lower bobbin.

16. The method according to claim 11, further comprising:

during a stitch retracting a thread length after a point when the loop of the upper thread has been taken around the lower bobbin and is beginning to be drawn tight.

17. The method according to claim 11, further comprising:

during a stitch feeing out a thread length after a point when the loop of the upper thread has been taken around the lower bobbin and is beginning to be drawn tight.

* * * * *